US005234113A

United States Patent [19]

Ramey

[11] Patent Number: 5,234,113

[45] Date of Patent: Aug. 10, 1993

[54] METHOD AND APPARATUS FOR DISPLAYING A PLURALITY OF ARTICLES

[75] Inventor: Arthur J. Ramey, Abingdon, Va.

[73] Assignee: Marley Mouldings, Inc., Marion, Va.

[21] Appl. No.: 880,853

[22] Filed: May 11, 1992

Related U.S. Application Data

[63] Continuation-in-part of Ser. No. 643,494, Jan. 22, 1991, Pat. No. 5,111,943.

[51] Int. Cl.[5] ..... B65D 71/00

[52] U.S. Cl. ..... 211/59.4; 211/60.1; 211/13; 40/299

[58] Field of Search ..... 211/59.4, 60.1, 13; 40/645, 299, 657; 206/457, 459

[56] References Cited

U.S. PATENT DOCUMENTS

| | | | |
|---|---|---|---|
| 1,242,872 | 10/1917 | Saunders . | |
| 2,627,682 | 2/1950 | Markey . | |
| 3,175,694 | 3/1965 | Reibold et al. | 211/60.1 |
| 3,227,503 | 1/1966 | Fletcher et al. | 211/60.1 X |
| 3,385,451 | 5/1968 | Anderson | 211/60.1 |
| 3,677,203 | 7/1972 | Barrineau | 211/59.4 X |
| 3,804,238 | 4/1974 | Howard . | |
| 3,888,349 | 6/1975 | MacFarland, Jr. . | |
| 3,910,412 | 10/1975 | Vargo . | |
| 4,168,002 | 9/1979 | Crosby | 40/645 X |
| 4,378,884 | 4/1983 | Anderson . | |
| 4,618,031 | 10/1986 | Belloche . | |
| 4,815,610 | 3/1989 | Borick et al. . | |
| 4,832,607 | 5/1989 | Dorrell | 211/13 X |
| 4,972,616 | 11/1990 | Doll | 40/645 |
| 5,004,270 | 4/1991 | Schaul et al. | 40/299 X |
| 5,111,943 | 5/1992 | Ramey | 211/59.4 |

*Primary Examiner*—Robert W. Gibson, Jr.
*Attorney, Agent, or Firm*—Shlesinger, Arkwright & Garvey

[57] ABSTRACT

A preferred embodiment includes a support member for supporting a plurality of articles. A directory, listing the articles supported by the support member, is operably associated therewith. The directory includes a first area listing a first group of articles and a second area listing a second group of articles. A group location identifier identifies the location of the first and second groups of articles. The group location identifier includes first and second members for identifying the location of the first and second groups of articles, respectively. An article location identifier identifies the location of the articles in at least the first group of articles. The article location identifier is removed from the group location identifier and the articles in the first group of articles. At least a portion of the first area, at least a portion of the first member and at least a portion of the article location identifier are formed from a first distinctive color. At least a portion of the second area and the second member are formed from a second distinctive color.

20 Claims, 5 Drawing Sheets

METHOD AND APPARATUS FOR DISPLAYING A PLURALITY OF ARTICLES

RELATED PATENT APPLICATIONS

The subject patent application is a continuation-in-part of U.S. patent application Ser. No. 07/643,494 filed on Jan. 22, 1991, now U.S. Pat. Nos. 5,111,943, May 12, 1992.

FIELD OF THE INVENTION

The present invention is directed to method and apparatus for displaying bulk commodities including such things as finished and unfinished mouldings, picture frames, windows, doors, lumber and other related mill work. More specifically, a preferred embodiment of the present invention relates to method and apparatus for displaying moulding.

BACKGROUND OF THE INVENTION

Numerous arrangements have been previously proposed to display articles in a commercial establishment. The following U.S. Pat. Nos. illustrate a number of display devices: U.S. Pat. Nos. 1,242,872; 2,627,682; 3,804,238; 3,888,349; 3,910,412; 4,378,884; 4,618,031; and, 4,815,610. Prior known display devices haVe been unable to satisfactorily display bulk commodities such as moulding and the like.

The display of moulding and other bulk commodities for sale presents a number of unique problems to the business proprietor not previously appreciated or resolved by known display devices. Specifically, it is often difficult for a consumer to locate the particular moulding or other bulk commodity he or she desires without the assistance of a sales person. This is a significant concern of many proprietors because of the recent trend toward self-service stores. In such establishments, it is necessary for a consumer to be able to readily locate the article he is seeking by himself. Unless the display device is such that will permit the consumer to readily locate the item, the consumer will most likely leave the store disgruntled and without making a purchase. Of course, this is detrimental to the operation of a successful business.

The difficulty in locating bulk commodities such as moulding and the like is attributable in part to the fact that such commodities are displayed over large areas in commercial establishments. In the case of moulding, it is necessary to allocate a large area for the display thereof because moulding is sold in rather lengthy strips and a number of different groups of mouldings are normally offered for sale to the consumer. Among the groups of mouldings commonly sold are chair rail moulding, base moulding, window moulding, door moulding, corner moulding, ceiling moulding and specialty moulding. Further hampering the consumer in locating the particular moulding he desires, is the fact that different groups of mouldings are not readily differentiable. A number of previously known display devices are designed to assist a customer in locating easily differentiable articles which are displayed in a rather small area of a storeroom and, therefore, are not acceptable for displaying moulding.

Another problem associated with the sale of moulding and similar commodities is that such commodities are sold unpackaged. Further, it is often undesirable to mark the article itself. A substantial number of prior display devices require that either the article or the package containing the article be marked in some fashion to assist the consumer in locating the same. Accordingly, these display devices are unable to accommodate moulding or related articles.

OBJECTS AND SUMMARY OF THE PRESENT INVENTION

An object of the present invention is to provide method and apparatus for displaying moulding and other bulk commodities in a manner which enables a consumer to readily locate the desired article without the assistance of sales persons.

Another object of the present invention is to provide a system for displaying a plurality of articles in a commercial establishment for permitting a customer to readily locate one or more of the displayed articles which includes support means for supporting a plurality of articles. The support means includes at least a first wall extending in a first direction and plurality of partitions connected to the first wall. Directory means lists the articles supported by the support means. The directory means includes a first area listing a first group of articles supported by the support means and a second area listing a second group of articles supported by the support means. Group location identifying means identifies the location of the first and second groups of articles on the support means. The group location identifying means includes at least first and second members. The first member identifies the location of the first group of articles and the second member identifies the location of the second group of articles. At least a portion of the first area and the first member are formed from a first distinctive color. At least a portion of the second area and the second member are formed from a second distinctive color. The first member is removed from the support means and extends at an angle to the at least a first wall.

The display system recited above is advantageous for numerous reasons, several of which are enumerated below. By providing directory means for listing the articles supported by the support means, a consumer can readily determine if the article he or she desires is available. Color coding the directory means and the group location identifying means assists the consumer in locating the group of articles he is seeking. This is particularly beneficial where the displayed articles, for example moulding, are categorized in several groups which cannot be readily distinguished by the average consumer. Positioning the first member removed from the support means at an angle to the first wall of the support means enables the consumer to readily observe the first member from a considerable distance thereto.

A further object of the present invention is to provide a system for displaying a plurality of articles in a commercial establishment for permitting a customer to readily locate one or more of the displayed articles which includes a support means for supporting a plurality of articles. A directory means lists the articles supported by the support means. The directory means includes a first area listing a first group of articles supported by the support means and a second area listing a second group of articles supported by the support means. Group location identifying means identifies the location of the first and second groups of articles on the support means. The group location identifying means includes at least first and second members. The first member identifies the location of the first group of articles and the second member identifies the location of the second group of articles. Article location identifying means locates the articles in at least the first group of articles. The article location identifying means is removed from the group location identifying means and the articles in the first group of articles. At least a portion of the first area, the first member and the article location identifying means is formed from a first distinctive color. At least a portion of the second area in the second member is formed from a second distinctive color.

The display system set forth above is a significant improvement over previously known devices. In this regard, it is noted that a consumer can readily review the directory means to determine if the article he desires is available. Also, the use of group location identifying means and article location identifying means in connection with the directory means permits a consumer to readily locate the particular article he or she is seeking. Moreover, the use of the color coded scheme recited above further assists the consumer in locating the desired article. Finally, by positioning the article location identifying means removed from the article, the present invention can effectively display bulk commodities such as moulding and the like.

Yet another object of the present invention is to provide a system for displaying a plurality of articles in a commercial establishment for permitting a customer to readily locate one or more of the displayed articles. A support means supports a plurality of articles and includes at least a first wall extending in a first direction and a plurality of partitions operably connected thereto. Directory means lists the articles supported by the support means. The directory means includes a first area listing a first group of articles supported by the support means and a second area listing a second group of articles supported by the support means. Group location identifying means identifies the location of the first and second groups of articles on the support means. The group location identifying means has at least first and second members. The first member identifies the location of the first group of articles and the second member identifies the location of the second group of articles. Article location identifying means identifies the location of the articles in at least the first group of articles. The article location identifying means is operably connected to the first wall. The system further includes means for supporting the first and second members from a ceiling of a store at an angle to the first wall. At least a portion of the first area, the first member and the article location identifying means are formed from a first distinctive color. At least a portion of the second area and the second member are formed from a second distinctive color.

The above display system is desirable for numerous reasons, several of which are identified below. The directory means readily enables a consumer to determine the availability of the article he or she desires. The provision of the group location identifying means and the article location identifying means assists the consumer in locating the article he or she desires. The use of a color coded scheme for linking the directory means, the group location identifying means and the article location identifying means further assists the consumer in locating a particular item. By supporting the group location identifying means from a ceiling, a consumer can readily observe the same from a considerable distance.

Still yet another object of the present invention is to provide a method for displaying a plurality of articles in a commercial establishment for permitting a customer to readily locate one or more of the displayed articles which includes the following steps:

a) providing support means for supporting a plurality of articles, the support means including at least a first wall having first and second ends extending in a first direction, a plurality of partitions operatively connected to the first wall;

b) providing directory means for listing the articles supported by the support means, the directory means includes a first area listing a first group of articles supported by the support means and a second area listing a second group of articles supported by the support means;

c) providing group location identifying means for identifying the location of the first and second groups of articles on the support means, the group location identifying means having at least first and second members, the first member identifies the location of the first group of articles and the second member identifies the location of the second group of articles;

d) suspending at least one of the first and second members from a ceiling of a commercial establishment at an angle to the first wall;

e) providing article location identifying means for locating the articles in at least the first group of articles;

f) supporting the article location identifying means on the first wall;

g) forming at least a portion of the first area, at least a portion of the first member and at least a portion of the article location identifying means from a first distinctive color; and, h) forming at least a portion of the second area and the second member from a second distinctive color.

The above method of displaying a plurality of articles is a significant improvement over previously known methods. By providing color coded directory means, group location identifying means, and article location identifying means a consumer can readily determine if a particular article is available and the location of the same. Suspending the group location identifying means from a ceiling readily permits the user to observe the same from a considerable distance. This feature is extremely advantageous in those instances where the articles are displayed over a large area of the commercial establishment.

These objects and advantages as well as others will be readily apparent from a review of the specification, the claims, and the accompanying drawings.

In summary, the present invention is directed to method and apparatus for displaying a plurality of articles. A preferred embodiment of the present invention includes a support member for supporting a plurality of articles. A directory, listing the articles supported by the support member, is operably associated therewith. The directory includes a first area listing a first group of articles and a second area listing a second group of articles. A group location identifier identifies the location of the first and second groups of articles. The group location identifier includes first and second members for identifying the location of the first and second groups of articles, respectively. An article location identifier identifies the location of the articles in at least the first group of articles. The article location identifier is removed from the group location identifier and the articles in the first group of articles. At least a portion of the first area, at least a portion of the first member and at least a portion of the article location identifier is formed from a first distinctive color. At least a portion of the second area and the second member is formed from a second distinctive color.

DETAILED DESCRIPTION OF THE DRAWINGS

DETAILED DESCRIPTION OF THE INVENTION

The preferred embodiment of the present invention will be described hereinafter with reference made to FIGS. 1 through 5.

Figure 1:
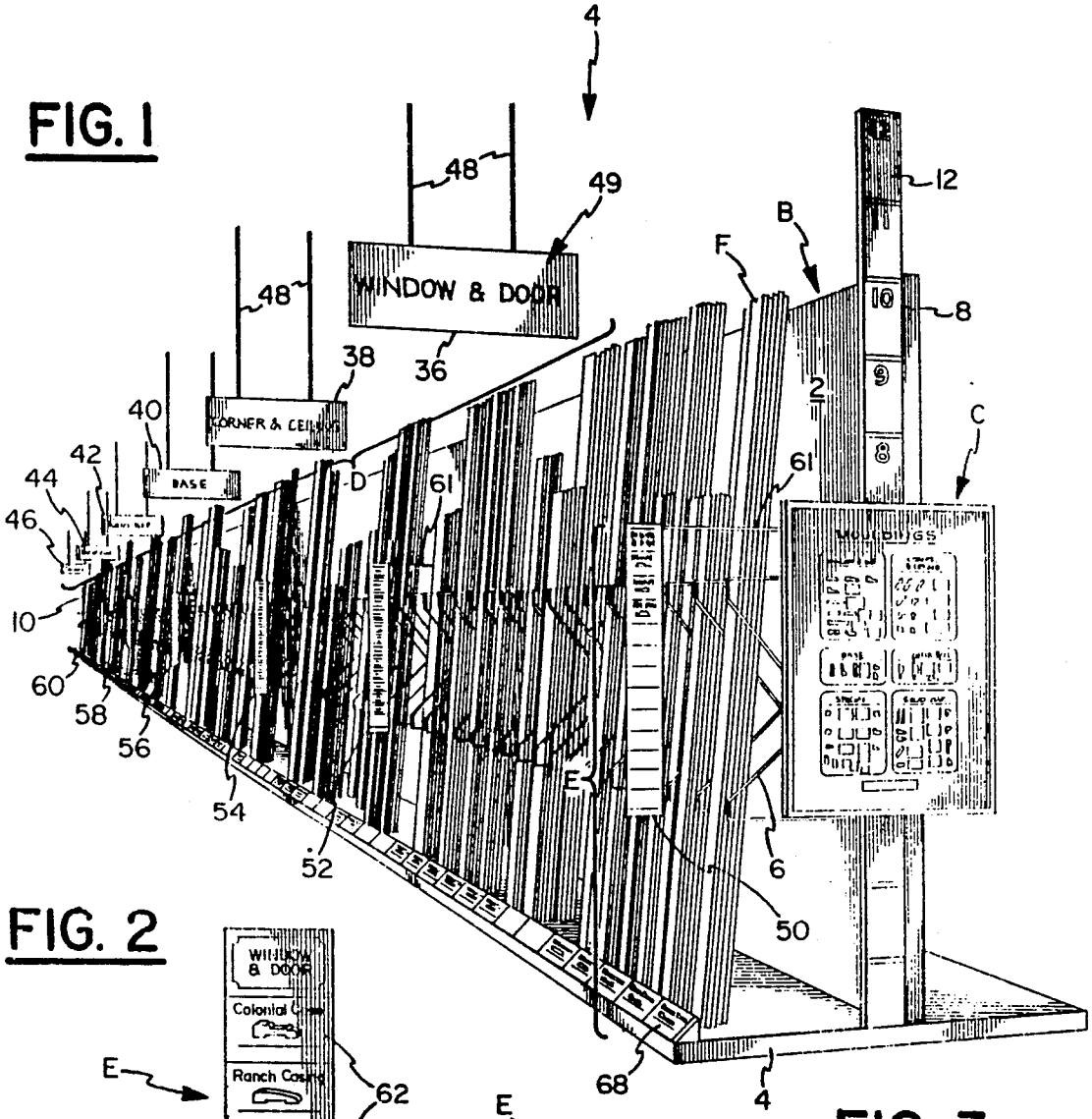
FIG. 1 is a perspective view of a preferred embodiment of the present invention.
Figure 2:
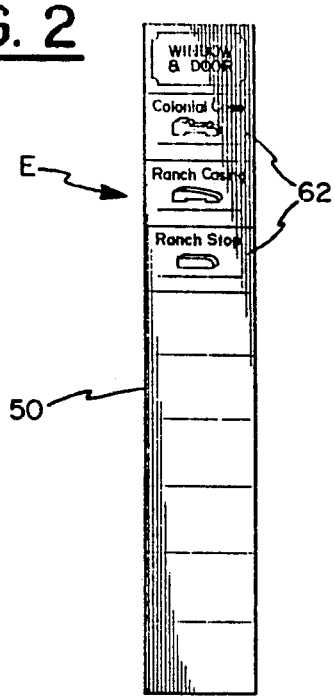
FIG. 2 is a front elevational view of an element of the preferred embodiment illustrated in FIG. 1.
Figure 3:
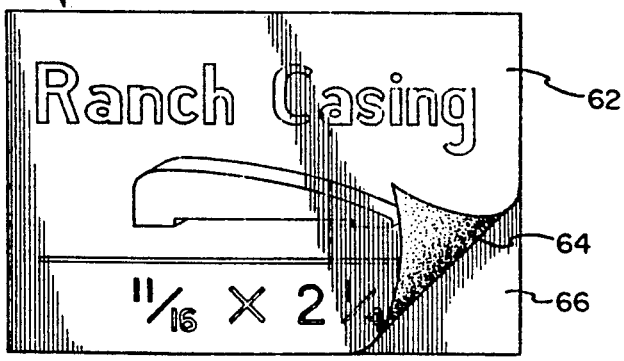
FIG. 3 is an enlarged front elevational view of a portion of the element illustrated in FIG. 2.

Referring to FIG. 1, the display system A includes a support member B, a directory C, a group location identifier D, and an article location identifier E. The support member B includes a vertical wall 2, a base 4 and a plurality of partitions 6. The vertical wall 2 includes a first end 8 and a second end 10 A scale 12 is positioned directly adjacent the first end 8 of vertical wall 2. The base 4 extends outwardly from each side of the wall 2 forming substantially right angles therewith. The partitions 6 are spaced at intervals along the wall 2 between the first end 8 and the second end 10. The partitions 6 may be secured to wall 2 by any conventional means. The moulding F is supported between adjacent partitions 6 in a manner which will be more fully described below.

Figure 4:
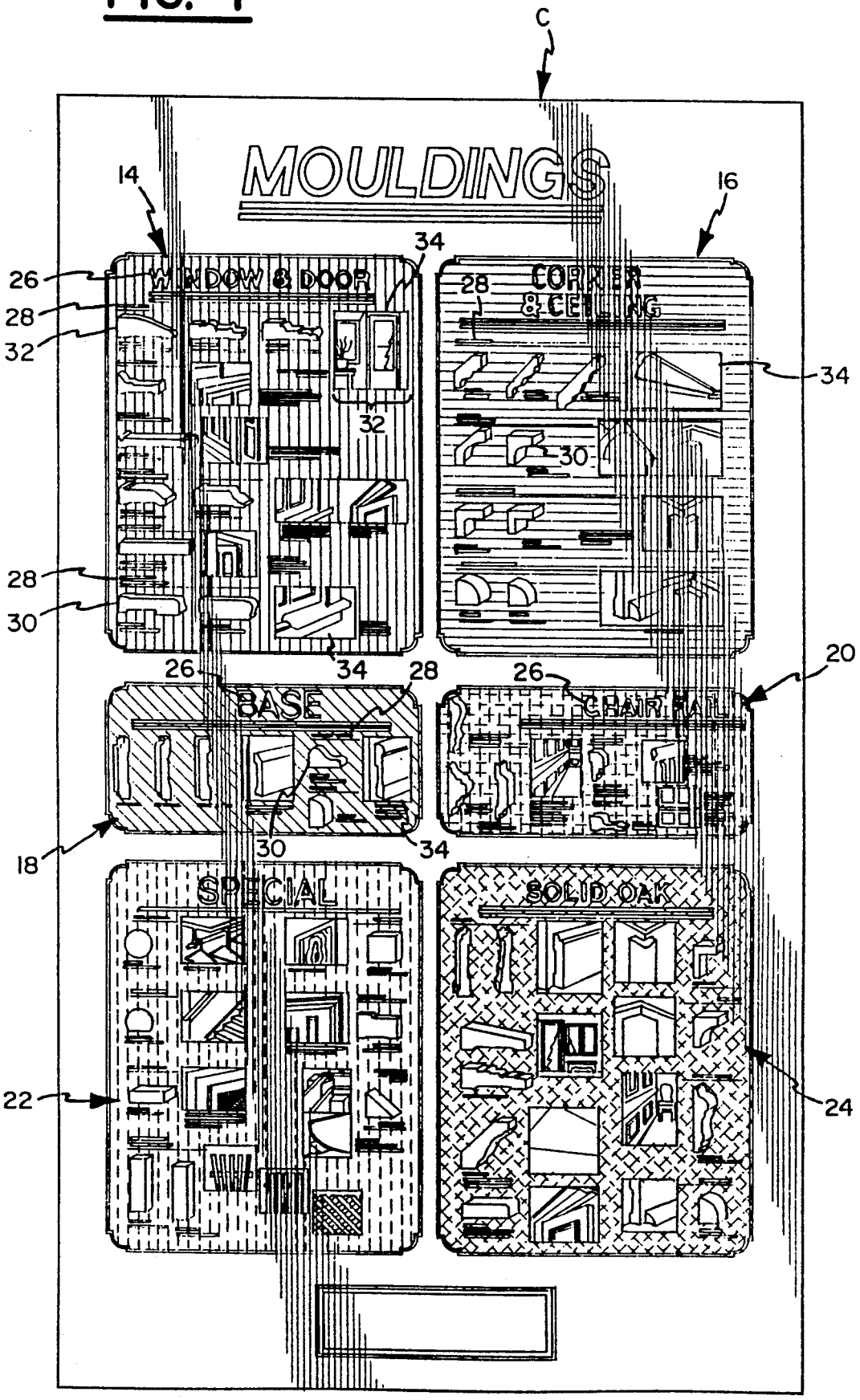
FIG. 4 is an enlarged front elevational view of another element of the preferred embodiment illustrated in FIG. 1.

Referring to FIGS. 1 and 4, the directory C is subdivided into six distinct areas 14, 16, 18, 20, 22 and 24. Preferably, area 14 is colored red or a shade thereof, second area 16 is colored blue or a shade thereof, third area 18 is colored green or a shade thereof, fourth area 20 is colored yellow or a shade thereof, fifth area 22 is colored purple or a shade thereof, and sixth area 24 is colored orange or a shade thereof. As seen in FIG. 4, the first area 14 includes a heading 26 which identifies the group of mouldings listed therein.

In the preferred embodiment, first area 14 is designated for listing window and door mouldings. First area 14 further includes descriptive wording 28 identifying the particular types of mouldings available in the window and door group. Illustrations 30 accompany wording 28 depicting the specific configuration of mouldings available within each type of moulding. For example, the second line 32 of first area 14 may include the heading "Casing" and several illustrations of the specific configurations of "Casing" mouldings available to the consumer. A graphic illustration 34 is provided to illustrate the use of each type of moulding listed in first area 14.

Preferably, the second area 16, the third area 18, the fourth area 20, the fifth area 22 and the sixth area 24 identify corner and ceiling moulding, base moulding, chair rail moulding, specialty moulding and solid oak moulding, respectively. Areas 16, 18, 20, 22 and 24 are subdivided in a similar manner to first area 14. Therefore, these areas will not be described in detail hereinafter.

Although directory C has been subdivided into six areas, it will be readily appreciated that the number of areas may be varied as desired. Further, the particular colors designated for each area may be varied. Moreover, the heading for each of the areas may be changed to accommodate articles other than moulding. As seen in FIG. 1, the directory C is mounted adjacent the first end 8 of wall 2. The areas 14, 16, 18, 20, 22 and 24 may be permanently or removably secured to the directory C.

Referring to FIGS. 1 and 4, the group location identifier D includes signs 36, 38, 40, 42, 44 and 46. Preferably, these signs are suspended by cables 48 from the ceiling to extend substantially perpendicular to wall 2. The signs 36, 38, 40, 42, 44, and 46 are spaced at intervals between the first end 8 and the second end 10 of wall 2.

Figure 5:
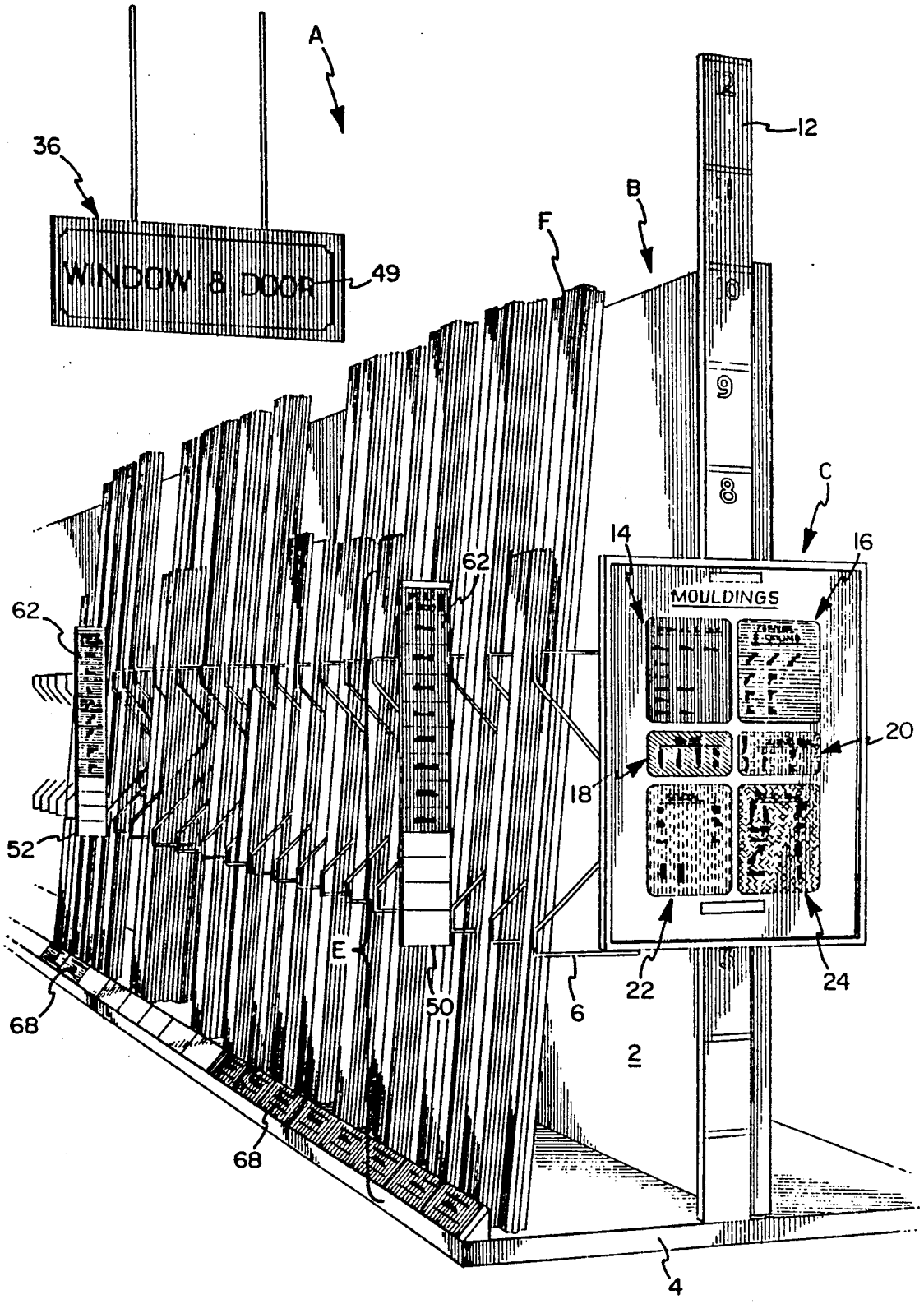
FIG. 5 is an enlarged perspective view of a portion of the preferred embodiment illustrated in FIG. 1.

Referring to FIG. 5, the sign 36 includes the heading 49 identifying the window and door group of moulding. Further, sign 36 is colored red or a shade thereof to correspond to the color of first area 14 of directory C. Window and door mouldings are positioned on the support member B adjacent sign 36. The heading "Corner and Ceiling" is printed on the sign 38 to correspond with the second area 16 of the directory C. Further, sign 38 is formed from the color blue or a shade thereof similar to that of second area 16.

Sign 40 includes the heading "Base" printed thereon corresponding to the third area 26. Sign 40 is colored green or a shade thereof in the same manner as third area 26. Sign 42 has the heading "Chair Rail" printed thereon and is formed from yellow or a shade thereof corresponding to the fourth area 20. Sign 44 includes the heading "Special" and is formed from the color purple or a shade thereof corresponding to the heading and color of fifth area 22. The sign 46 has printed thereon the heading "Solid Oak" and is formed from orange or a shade thereof corresponding to the heading and color of the sixth area 24. It will be readily appreciated that the mouldings corresponding to the headings on signs 38, 40, 42, 44 and 46 are stored on support member B adjacent thereto.

Article location identifier E includes display panels 50, 52, 54, 56, 58 and 60. Preferably, these display panels are supported by a bar 61 extending outwardly from the support member B. As seen in FIG. 1, the display panels extend substantially at a right angle to the support member B and parallel to the display signs of the group location identifier D. It will be readily appreciated that alternative means for supporting the display panels may be provided. For example, the display panels may be supported by the partition 6 or suspended from the ceiling of the commercial establishment.

Referring to FIG. 5, the display panel 50 has the heading "Window and Door" printed thereon corresponding to sign 36 and area 14. A plurality of removable card members 62 are secured to the display panel 50. The card members 62 are formed from the color red or a similar shade corresponding to the color of sign 36 and first area 14. The card members 62 include descriptive wording and graphic illustrations of the mouldings available within the window and door group, see FIGS. 2 and 3. The card members 62 are provided with an adhesive 64 on substantially the entire rear surface thereof and a peel-off member 66. Upon removal of the peel-off member 66, the card member 62 is secured to the display panel 50. Display panels 52, 54, 56, 58 and 60 are formed in a similar manner as display panel 50. More specifically, these display panels are provided with headings and are formed from the same color as the corresponding display signs. Further, each of the display panels 52, 54, 56, 58 and 60 include card members similar to card members 62 of display panel 50. The card members identify the mouldings available within the corresponding group via descriptive wording and graphic illustrations.

The article location identifier E further includes a plurality of cards 68 extending along the base 4 of support B. The cards 68 are formed from the color of the corresponding group. Therefore, the cards 68 extending along that portion of the support member B designated for window and door mouldings are colored red or a shade thereof, as seen in FIG. 5. The cards 68 further include descriptive wording and graphic illustrations of the particular mouldings stored directly adjacent thereto.

OPERATION

The preferred manner in which a consumer may use the display system A to locate a particular piece of moulding F will be described hereinafter.

A number of businesses have significantly cut back on their sales staff or have gone to a self-service type operation. Accordingly, more and more the consumer is required to locate the particular article he or she desires without the assistance of a sales person. The display system A readily permits a consumer to locate the moulding he desires entirely on his own. More specifically, the consumer may review the directory C to determine the groups of mouldings available, the types of moulding within each group and the use thereof. For example, if the consumer is seeking base moulding, area 18 lists the type of base mouldings available and illustrates the use thereof. Further, the consumer will readily appreciate that base moulding is displayed adjacent display sign 40 from the similar colors of sign 40 and area 18. Accordingly, the consumer need not look at all the mouldings supported by support member B.

Once the consumer has reached the general area below sign 40, the display panel 56 assists him in locating the particular moulding he desires. The card members 62 on display panel 56 list the particular moulding available within the base group. Since the display panel 56 lists all of the mouldings available within the base group of moulding, the consumer need not refer back to the directory C. Preferably, the card members 62 on display panel 56 are listed in the sequence in which they are stored on the support member B to further assist the consumer. Removable card members 62 readily permit the business proprietor to change the mouldings offered for sale within a particular group of moulding. Furthermore, once a particular moulding has sold out, the corresponding card 62 may be removed to indicate the same to the consumer. Card members 68 provide the consumer with the exact location of a particular moulding.

Although the display system A has been described in connection with moulding, it will be readily appreciated that numerous other articles may be displayed thereby.

ALTERNATIVE EMBODIMENT

An alternative embodiment of the present invention will be described in connection with FIGS. 6 and 7. The alternative embodiment incorporates all of the features of the preferred embodiment described and illustrated in FIGS. 1 through 5. Accordingly, the common features will be designated with the corresponding letters and reference numerals.

The display system A further includes one or more room scene signs G. As seen in FIG. 6, the room scene signs G are supported by brackets 70 extending from support member B. It will be readily appreciated that other means may be used for supporting room scene signs G adjacent the support member B.

Figure 6:
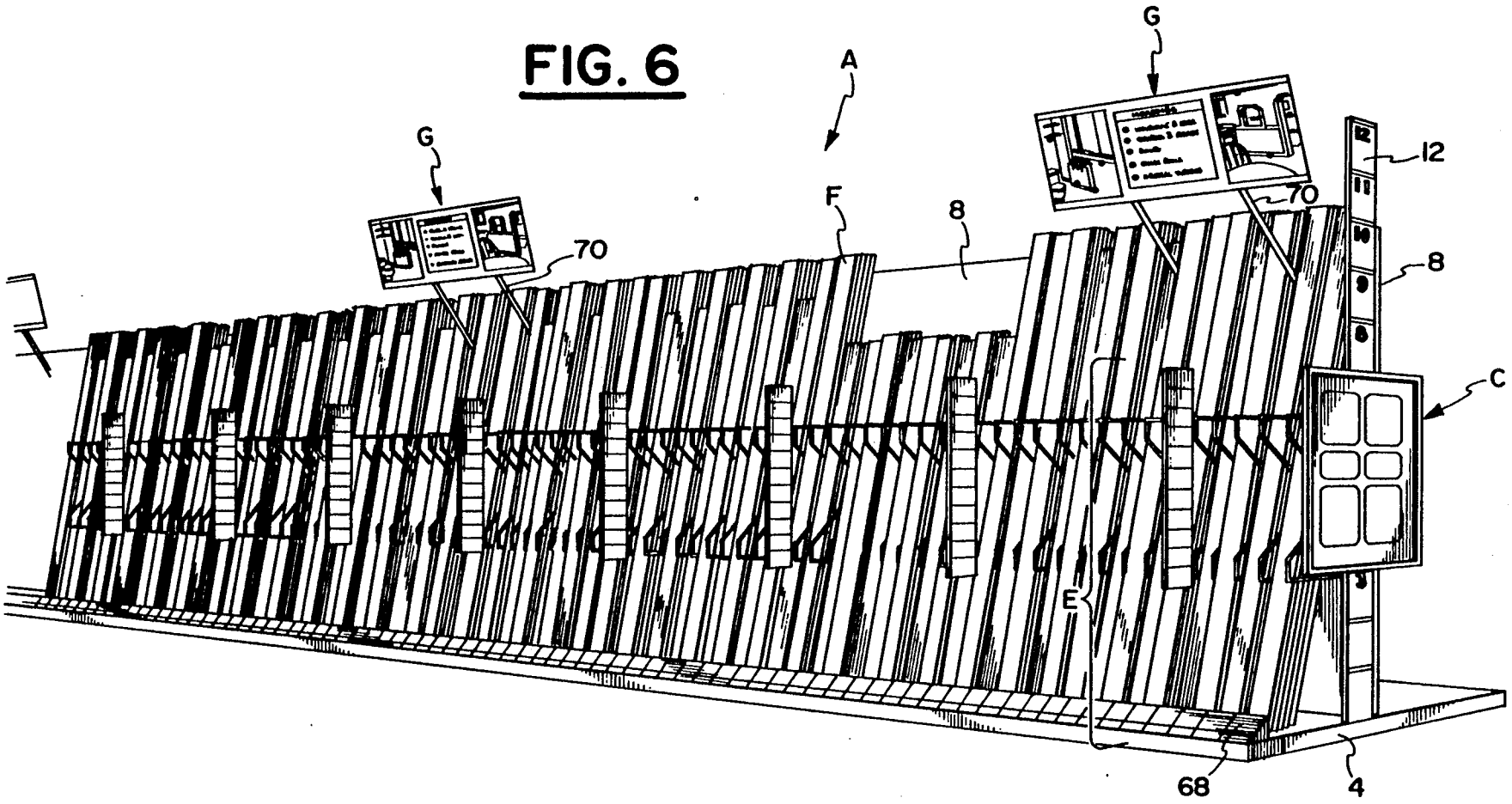
FIG. 6 is a perspective view of an alternative embodiment of the present invention.

The group display signs D have been omitted from FIG. 6. This has been done merely to better illustrate the room scene signs G. Therefore, it should be understood that the group display signs D form a part of the alternative embodiment. However, it will be readily appreciated that the group display signs D as well as other elements of the display system A may be omitted if the particular circumstances of the merchandiser warrant.

Figure 7:
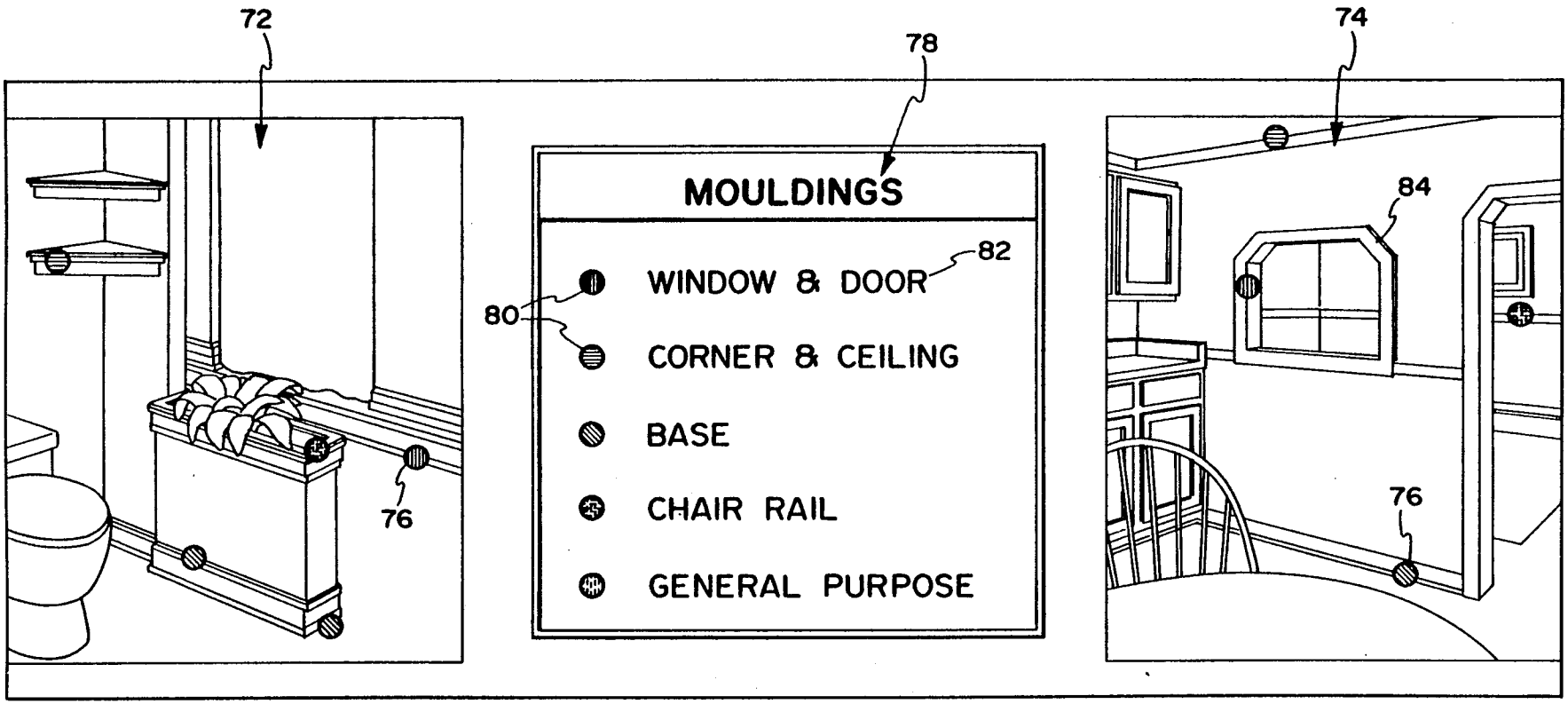
FIG. 7 is an enlarged planned view of the room scene sign.

Referring to FIG. 7, the room scene sign G includes two room scenes 72 and 74 graphically illustrating a portion of a room in a household. More specifically, illustration 72 depicts a portion of a restroom while illustration 74 depicts a portion of a kitchen. It will be readily appreciated that various other rooms of a household, office or the like may be portrayed.

Illustrations 72 and 74 depict various styles of moulding in the installed position. A distinct color indicator/identifier 76 is associated with each of the various styles of moulding strips to assist the consumer in identifying the specific kind of moulding he or she may need. The room scene signs G further includes a legend 78. The legend 78 includes distinct color indicators 80 and descriptive wording 82 associated therewith. The cross-hatchings for color indicates 80 represent the following: (1) "Window & Door"—Red; (2) "Corner & Ceiling"—Blue; (3) "Base"—Green; (4) "Chair Rail"—Yellow; (5) "General Purpose"—Purple. The same color/cross-hatching code is used for color indicators 76. It will be readily appreciated that the color indicator 76 will correspond to the color indicators 80 for the particular style of moulding. For example, the moulding surrounding the window 84 in illustration 74 is provided with a red color indicator 76 which corresponds to the red color indicator 80 associated with the descriptive working "window and door" found in legend 78. Therefore, a consumer can readily look at the graphic illustrations and find the color indicator associated with the type of moulding he or she desires. A reference to the legend will readily describe the type of moulding to the consumer. Using the group signs D and the article locators E a consumer can readily determine the location on support member B of the particular moulding he or she wishes to purchase.

While this invention has been described as having a preferred design, it is understood that it is capable of further modifications, uses and/or adaptations of the invention following in general the principles of the invention and including such departures from the present disclosure as come within known or customary practice in the art to which the present invention pertains, and as may be applied to the essential features hereinbefore set forth, and fall within the scope of the invention or the limits of the appended claims.

I claim:

1. An apparatus for displaying a plurality of moulding strips, comprising:

a) a support member having at least first and second groups of moulding strips positioned thereon;

b) at least first and second group locators, said first and second group locators having indicia identifying a corresponding group of moulding strips, said first and second group locators being positioned adjacent said support member;

c) at least first and second article locators, said first and second article locators being positioned along said support member and removed from said first and second group locators;

d) at least a portion of said first group locator being formed from a first color and at least a portion of said second group locator being formed from a second color;

e) at least a portion of said first article locator being formed from said first color and at least a portion of said second article locator being formed from said second color.

2. An apparatus as in claim 1, further including:

a) a room scene member operably associated with said support member, said room scene member having a graphic illustration of at least a portion of a room, said graphic illustration depicting at least one type of moulding supported by said support member in the installed position.

3. An apparatus as in claim 2, wherein:

a) said graphic illustration depicts first and second types of moulding strips, said room scene member further includes first and second moulding type identifiers, said first and second identifiers being formed from said first and second colors, respectively.

4. An apparatus as in claim 3, wherein:

a) said room scene member further includes a legend explaining the type of moulding corresponding to said first and second colors.

5. An apparatus as in claim 1, further including:

a) a directory associated with said support member, said directory lists at least first and second types of moulding strips supported on said support member.

6. An apparatus as in claim 5, wherein:

a) said directory includes first and second portions, said first portion being formed from said first color and said second portion being formed from said second color.

7. An apparatus as in claim 1, wherein:

a) said first and second article locators extend substantially parallel to said first and second group locators.

8. An apparatus as in claim 1, wherein:

a) said first and second group locators are suspended from a ceiling; and, b) said first and second article locators are suspended from said support member.

9. An apparatus for displaying a plurality of moulding strips, comprising:

a) support member having a plurality of moulding strips positioned thereon;

b) directory listing at least first and second types of moulding strips positioned on said support member, said directory having first and second portions, said first portion being formed from a first color corresponding to the first type of moulding strip, said second portion being formed from a second color corresponding to the second type of moulding strip;

c) at least first and second moulding location identifiers for identifying the location of the first and second types of moulding strips, respectively; and, d) at least a portion of said first moulding location identifier being formed from the first color and at least a portion of said second moulding location identifier being formed from the second color, said first and second moulding location identifiers each having indicia identifying the type of moulding positioned adjacent thereto.

10. An apparatus as in claim 9, wherein:

a) said directory is a single display sign.

11. An apparatus as in claim 9, further including:

a) a room scene sign operably associated with said support member, said room scene member having a graphic illustration of at least a portion of a room, said graphic illustration depicting at least one type of moulding supported by said support member in the installed position.

12. An apparatus as in claim 11, wherein:

a) said graphic illustration depicts first and second types of moulding strips, said room scene member further includes first and second moulding type identifiers, said first and second identifiers being formed from said first and second colors respectively.

13. An apparatus as in claim 12, wherein:

a) said room scene member further includes a legend explaining the type of moulding corresponding to said first and second colors.

14. An apparatus as in claim 9, wherein:

a) said directory includes graphic illustrations depicting intended uses of said first and second types of moulding strips.

15. An apparatus as in claim 14, wherein:

a) said directory includes graphic illustrations depicting cross-sections of said first and second types of moulding strips.

16. An apparatus as in claim 9, wherein:

a) said first moulding location identifier includes a panel member and at least two cards operably associated with said panel member, said cards each include indicia depicting cross-section of a corresponding moulding strip.

17. An apparatus as in claim 16, wherein:

a) said cards are releasably secured to said panel member.

18. A method for displaying a plurality of moulding strips, comprising the steps of:

a) providing a support member having at least first and second groups of moulding strips positioned thereon;

b) providing at least first and second group locators, the first and second group locators having indicia identifying a corresponding group of moulding strips;

c) positioning the at least first and second group locators along the support member;

d) providing at least first and second article locators;

e) positioning thearticle locaors along the support member and removed from the first and second group locators;

f) forming at least a portion of the first and second group locators from first and second colors, respectively; and, g) forming at least a portion of the first and second article locators from the first and second colors, respectively.

19. The method as recited in claim 18, further including the step of:

a) providing a room scene member operably associated with said support member, said room scene member having a graphic illustration of a room, said graphic illustration depicting first and second types of moulding strips, said room scene member further having first and second moulding type identifiers, the first and second identifiers being formed from the first and second colors. respectively.

20. The method as recited in claim 18, further including the step of:

a) providing a directory operably associated with the support member, the directory listing at least first and second types of moulding strips supported on the support member.

* * * * *

UNITED STATES PATENT AND TRADEMARK OFFICE

CERTIFICATE OF CORRECTION

PATENT NO. : 5,234,113

DATED : August 10, 1993

INVENTOR(S) : Arthur J. Ramey

It is certified that error appears in the above-indentified patent and that said Letters Patent is hereby corrected as shown below:

In the drawing:

Sheet 1, Figure 1, delete system reference "4" at the top of Figure 1 and insert therefor --A--.

Column 1, line 26, delete "haVe" and insert therefor --have--.

Column 6, line 19, delete "4" and insert therefor --5--;
line 37, delete "26" and insert therefor --18--;
line 39, delete "26" and insert therefor --18--.

Col. 10, line 66:

Claim 18, subparagraph e, line 1, delete "thearticle locaors" and insert therefor --the article locators--.

Signed and Sealed this

Third Day of May, 1994

Bruce Lehman

*Attest:*

BRUCE LEHMAN

*Attesting Officer*

*Commissioner of Patents and Trademarks*